US005915793A

United States Patent [19]

Serpa

[11] Patent Number: 5,915,793

[45] Date of Patent: Jun. 29, 1999

[54] KNIFE/SHEATH LOCKING DEVICE

[76] Inventor: Michael Lawrence Serpa, P.O. Box 2693, Newport Beach, Calif. 92659

[21] Appl. No.: 09/008,672

[22] Filed: Jan. 16, 1998

Related U.S. Application Data

[63] Continuation-in-part of application No. 08/779,258, Jan. 3, 1997, Pat. No. 5,794,347.

[51] Int. Cl.[6] ..... B26B 29/02

[52] U.S. Cl. ..... 30/162; 30/151; 224/232

[58] Field of Search ..... 30/151, 162; 224/232; 24/614, 615, 616, 617, 625

[56] References Cited

U.S. PATENT DOCUMENTS

| | | | |
|---|---|---|---|
| 2,391,574 | 12/1945 | Housinger . | |
| 2,527,710 | 10/1950 | Davidson . | |
| 2,618,057 | 11/1952 | Gibson . | |
| 2,783,536 | 3/1957 | McQueary . | |
| 2,901,823 | 9/1959 | Widen . | |
| 3,524,570 | 8/1970 | Seguine . | |
| 4,150,464 | 4/1979 | Tracy . | |
| 4,404,747 | 9/1983 | Collins . | |
| 4,835,863 | 6/1989 | Salandre . | |
| 4,854,044 | 8/1989 | Collins . | |
| 5,067,239 | 11/1991 | Collins . | |
| 5,092,046 | 3/1992 | Collins . | |
| 5,123,167 | 6/1992 | Kelley . | |
| 5,146,684 | 9/1992 | Hagler . | |
| 5,222,279 | 6/1993 | Frano et al. . | |
| 5,379,520 | 1/1995 | Collins . | |
| 5,507,076 | 4/1996 | Anscher . | |
| 5,647,130 | 7/1997 | Collins | 30/151 |
| 5,794,347 | 8/1998 | Serpa | 30/162 |

*Primary Examiner*—Hwei-Slu Payer

[57] ABSTRACT

A knife/sheath locking assembly for retaining a knife (10) or other tool within a sheath (16). Two flexible arms (18) extend outward from opposite sides of the open end (17) of the sheath (16). The handle (12) of the knife (10) includes two tunnel structures (32) located proximal to the blade (14) and spaced to cooperatively accept the flexible arms (18) of the sheath (16). Latch means disposed on each flexible arm (18) comprised of a recess or notch (29) retain the knife (10) within the sheath (16) by engaging a tooth (25) located in a corresponding position within each tunnel structure (32), and removal of the knife (10) requires the inward urging of the distal ends (22) of the flexible arms (18).

4 Claims, 6 Drawing Sheets

KNIFE/SHEATH LOCKING DEVICE

This is a Continuation In Part of U.S. patent application Ser. No. 08/779,258 filed Jan. 3, 1997, now U.S. Pat. No. 5,794,347.

FIELD OF THE INVENTION

This invention relates to an improved molded device for locking a knife or other tool in a sheath.

1. Background of the Invention

A variety of mechanical devices have been developed for securely holding a tool, such as a knife, in a sheath in a manner that permits the user to quickly and easily release the knife from the sheath when desired. These features are particularly important for sporting and/or rescue purposes while in water or underwater, such as for use by underwater divers. Underwater divers must be able to remove a knife from a sheath quickly and easily while being assured that, when not in use, the knife will remain securely in the sheath even in extreme conditions.

DISCUSSION OF PRIOR ART

One type of knife and sheath combination holds the knife in place simply by friction between the blade of the knife and the sheath. This combination is not suitable for underwater divers because movements of the diver in the water may inadvertently cause the blade to lose frictional engagement with the sheath.

Other devices include knife and sheath assemblies using spring loaded buttons to hold the knife in place. Such knife and sheath combinations are exemplified by Housinger, U.S. Pat. No. 2,391,574 issued Dec. 25, 1945; Widen, U.S. Pat. No. 2,901,823 issued Sep. 1, 1959; Collins, U.S. Pat. No. 4,404,747 issued Sep. 20, 1983; and Collins, U.S. Pat. No. 4,854,044 issued Aug. 8, 1989. Each of these patents provide locking mechanisms in which spring loaded detents interengage a sheath or similar holder. While such arrangements provide a rapid release locking mechanism, the constructions either involve an assembly of a number of components or involve the use of separate moving parts while in use. These factors complicate the production of these inventions. Additionally, the many parts involved possibly increase the risk of corrosion, wear and tear, or failure while in use.

Collins, U.S. Pat. No. 5,067,239 issued Nov. 26, 1991, provides a laterally sliding lock mechanism on the sheath to hold the knife. Some users, however, may find using a lateral thumb motion difficult or uncomfortable for releasing a knife. Furthermore, the tab arrangement has a substantially one-sided arrangement that might not be suitable for all users.

Two other designs provide knife/sheath locking assemblies that can be integrally molded and are therefore relatively simple to manufacture and assemble. The first, Kelley, U.S. Pat. No. 5,123,167 issued Jun. 23, 1992, provides a flexible arm member offset from the main portion of the handle with a latch component located on the inner surface of the flexible arm. The latch component engages an upper edge of the sheath to hold the knife in place. One disadvantage of this design is that an obstruction, such as seaweed or monofilament line, could snag on the recess defined by the arm member and the main portion of the handle while the knife is in use. Additionally, because a portion of this same recess is exposed while the knife is in the sheath, a foreign object could enter the recess thereby preventing an inward flex of the arm and making withdrawal of the knife difficult.

The second design that can be integrally molded, Collins, U.S. Pat. No. 5,379,520 issued Jan. 10, 1995, provides an integrally molded sheath assembly that includes a lever angled to engage a band circumventing the knife handle. This design creates an exposed gap between the button end of the lever and the knife handle, thereby creating a risk that a foreign object could enter this gap and prevent the user from flexing the lever to withdraw the knife. Additionally, this design cannot be used with a knife having a finger guard on both sides of the knife because such an arrangement would interfere with the lever/band locking mechanism.

Reference is also made here to Anscher, U.S. Pat. No. 5,507,076 issued Apr. 16, 1996. This design provides a buckle comprising separate receptacle and clasp/latch members. Though the Anscher design is not a knife/sheath locking device, the latch mechanism of the present invention is similar to this design. However, Anscher is specifically limited to providing a buckle and is therefore distinct from the present invention. Additionally, the present invention provides a knife handle in place of the female socket member of Anscher. Finally, the present invention provides a sheath in place of the plug member used in Anscher.

OBJECTS AND ADVANTAGES

Accordingly, it is an object of the present invention to provide a knife and sheath combination that is simple to operate, reliable and durable in design, and capable of holding the knife securely in the sheath under the most extreme conditions while providing a quick and positive release at the appropriate time.

A further object of the present invention is to provide a knife and sheath combination that can be used by either a right-handed or left-handed person with equal ease and with the knife capable of being inserted in the sheath with the blade facing either forward or rearward.

A still further object of the present invention is to provide a knife/sheath combination that has a streamlined shape, substantially free of protuberances that can snag on foreign objects, both while the knife is in the sheath and while the knife is being used.

A still further object of the present invention is to provide a knife and sheath locking mechanism that can be used with a knife design incorporating finger guards on both sides of the knife handle.

A still further object of the present invention is to allow for a knife/sheath locking combination that is compatible with a relatively small knife.

A still further object of the present invention is to provide an improved knife/sheath locking mechanism that can be economically manufactured using injection molding production techniques.

Still other objects and advantages of the present invention will become apparent from a consideration of the ensuing description and drawings.

DETAILED DESCRIPTION OF THE INVENTION

(FIGS. 1 THROUGH 6, 9, AND 10)

Figure 1:
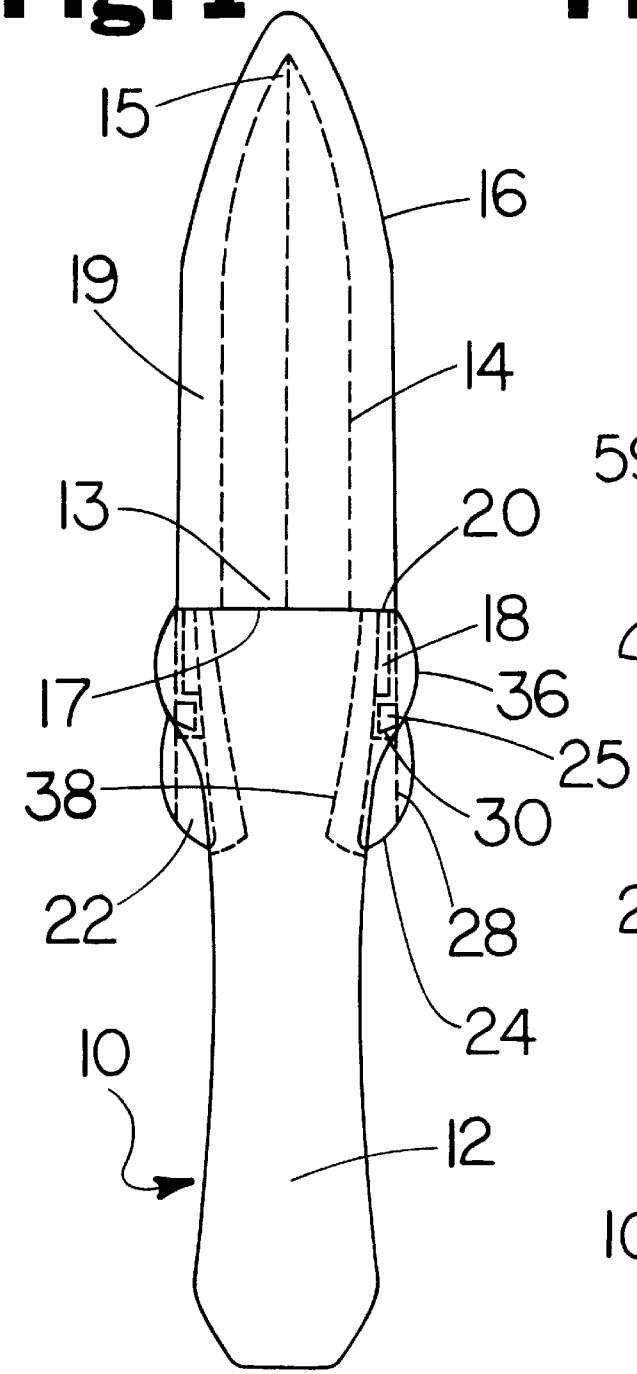
FIG. 1 is a side elevational view of a first embodiment of the present invention showing the knife secured within the sheath.

Referring to the drawings, a knife 10 having a handle 12 and a blade 14 is shaped to be secured within a sheath 16. Both the handle 12 and the sheath 16 are preferably molded from a tough resilient plastic material such as nylon. In both the first embodiment and the second embodiment illustrated, the knife 10 and sheath 16 combination is designed for use by underwater divers or by other users who require an easily accessible knife suitable for situations where the knife may be wholly or partially submerged in water.

As can be seen in the drawings, the first embodiment and the second embodiment of the present invention differ only in the orientation of the locking mechanism with respect to the blade 14 of the knife 10. The basic locking mechanism operates the same whether it is oriented near the side of the blade 14 or the edge of the blade 14. Different users might prefer one embodiment over the other.

The blade 14 has a tip 15 and a base 13. The sheath 16 is formed with a knife encasing portion 19 and an open end 17 into which the blade 14 of the knife 10 is inserted.

The sheath 16 preferably includes two flexible arms 18 formed on opposite sides of the sheath 16 and extending outward away from the open end 17 of the sheath 16 a predetermined distance. Each flexible arm 18 includes a first proximal end 20 connected to the sheath 16 and a second opposite distal end 22. The distal end 22 of each flexible arm 18 includes a rounded protrusion 24 on its outside surface, the purpose and operation of which will be explained in detail below.

The handle 12 preferably includes two tubular structures or tunnels 32, each with front opening 33 located adjacent to the base 13 of the blade 14 and a rear opening 39 located distal to the blade 14. The tunnels 32 are located on opposite sides of the handle 12 and are each defined by a first surface or top wall 34, a second surface or bottom wall 35, a third surface or outer wall 36, and a fourth surface or tunnel floor 38. The rear openings 39 may take a number of shapes depending upon variations in the configuration of the top walls 34, the bottom walls 35, and the tunnel floors 38.

As will be explained in detail below, the flexible arms 18 of the sheath 16 are received and retained within the tunnels 32 of the handle 12 in a releasable manner, thus providing a means for securing the knife 10 within the sheath 16.

To secure the knife 10 within the sheath 16, the inner surface of each outer wall 36 includes an inwardly projecting tooth 25. Each tooth 25 includes a locking surface 30 which is substantially in alignment with the rear openings 39 of the tunnel 32 in which the tooth 25 is located.

To engage the flexible arms 18 of the sheath 16 within the handle 12 in a releasable manner, the outside surface of the rounded protrusion 24 on each flexible arm 18 includes a groove 28. The groove 28 is aligned in one direction along, generally, the central longitudinal axis of the flexible arm 18. The groove 28 is of a size to enable it to receive the tooth 25 when the knife 10 is inserted into the sheath 16.

Each groove 28 is formed with a notch 29 proximal to the distal end 22 of the particular flexible arm 18. The notch 29 is deeper than the groove 28 so as to define a locking shoulder in the flexible arm 18 with which the locking surface 30 of the tooth 25 is adapted to engage. The notch 29 should be positioned along the flexible arm 18 at a predetermined point such that it engages the tooth 25 when the knife 10 is fully inserted into the sheath 16. The notch 29 may go deep enough to extend completely through the flexible arm 18 to form a hole.

Figure 2:
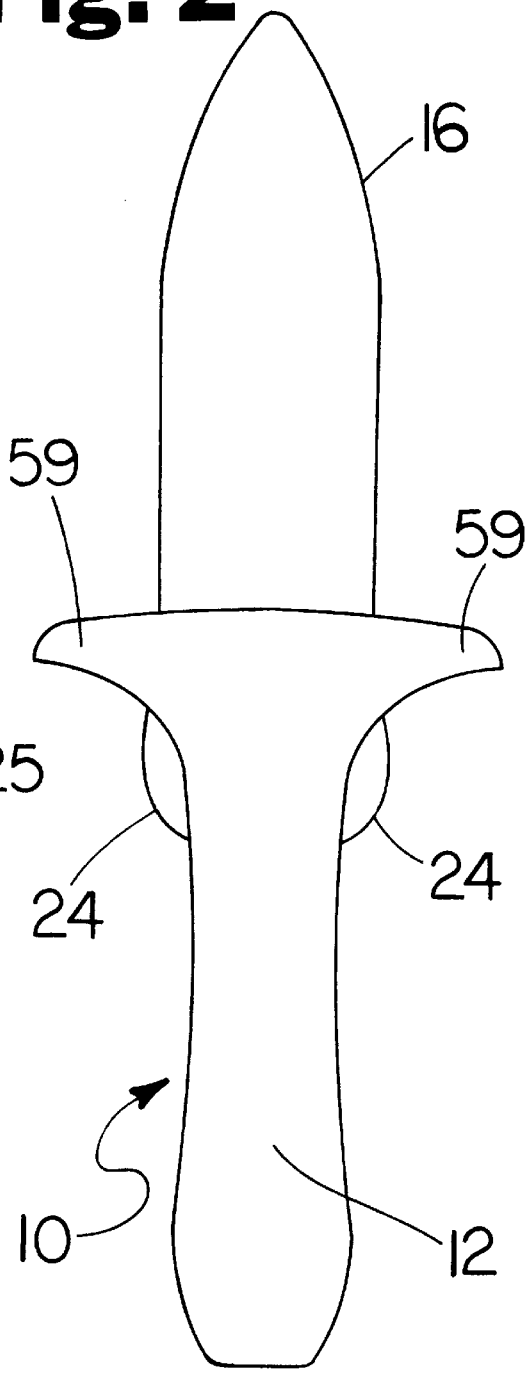
FIG. 2 is a side elevational view of the embodiment shown in FIG. 1 used with a knife having finger guards on the handle.
Figure 3:
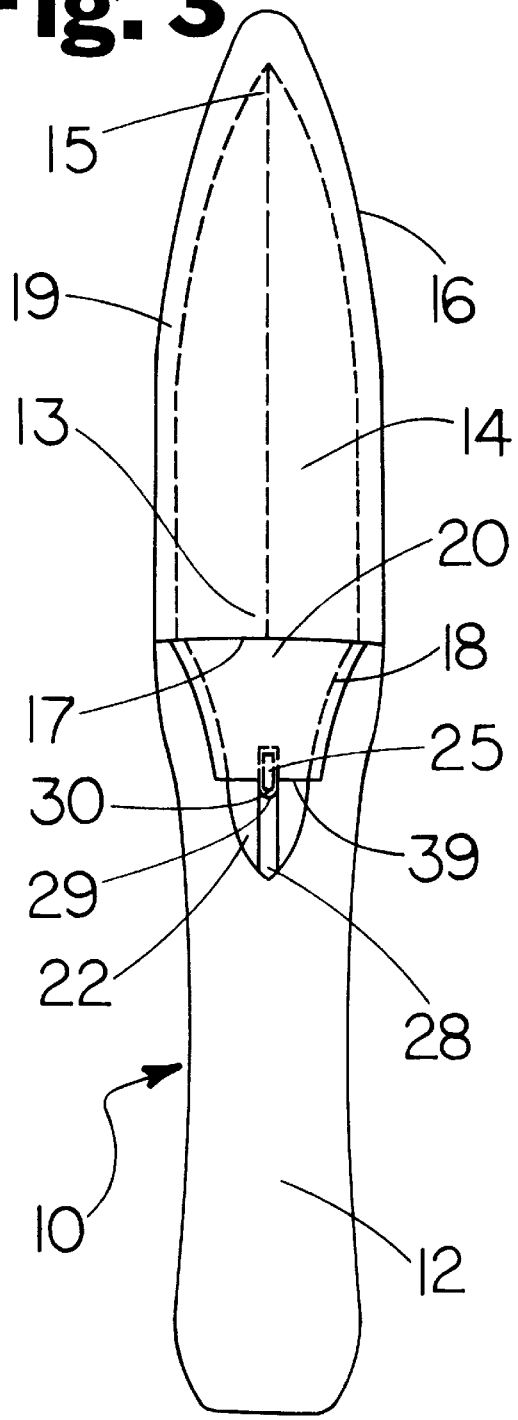
FIG. 3 is a side elevational view of a second embodiment of the present invention, with the locking mechanism oriented toward a different position with respect to the blade of the knife, showing the knife secured within the sheath.
Figure 4:
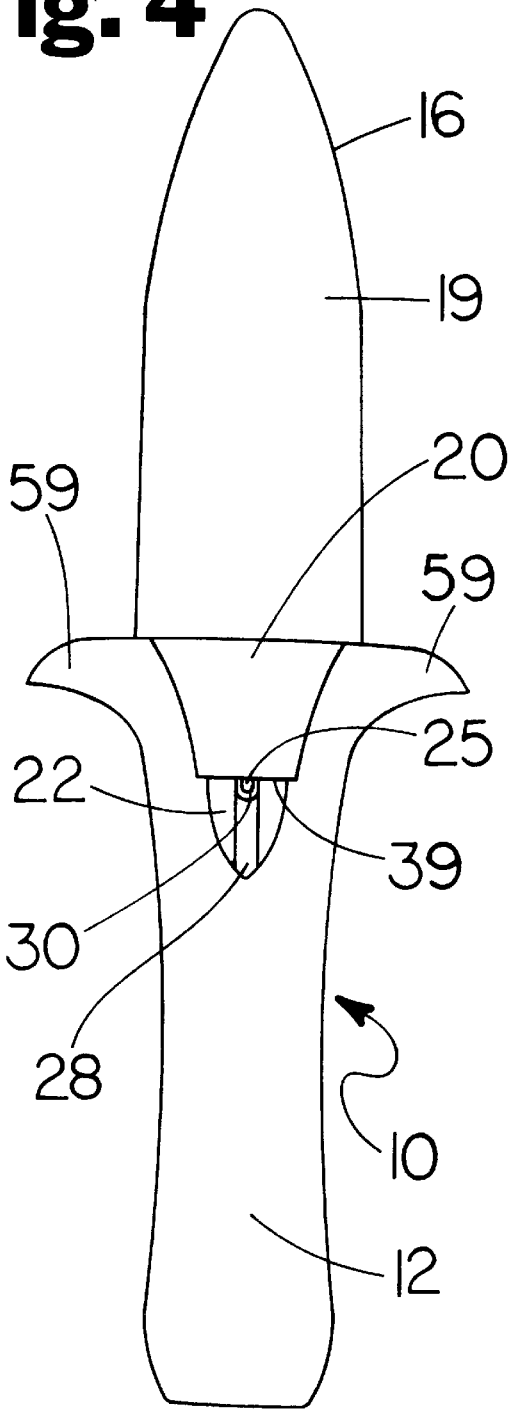
FIG. 4 is a side elevational view of the embodiment shown in FIG. 3 used with a knife having finger guards on the handle.
Figure 5:
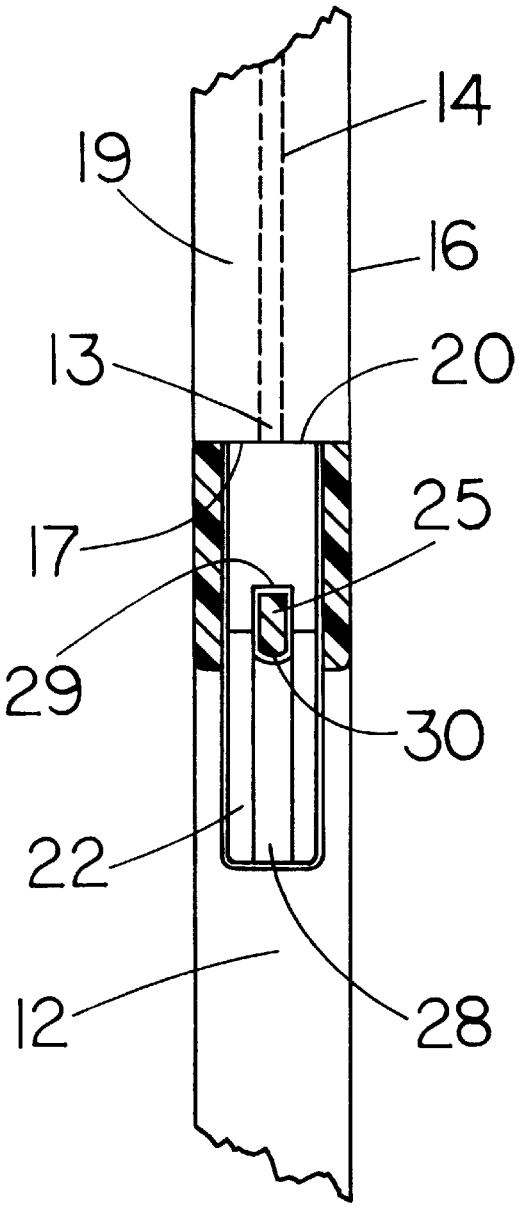
FIG. 5 is an elevational view of an edge of the first embodiment in the locked position shown partially cut away to expose the locking mechanism.
Figure 6:
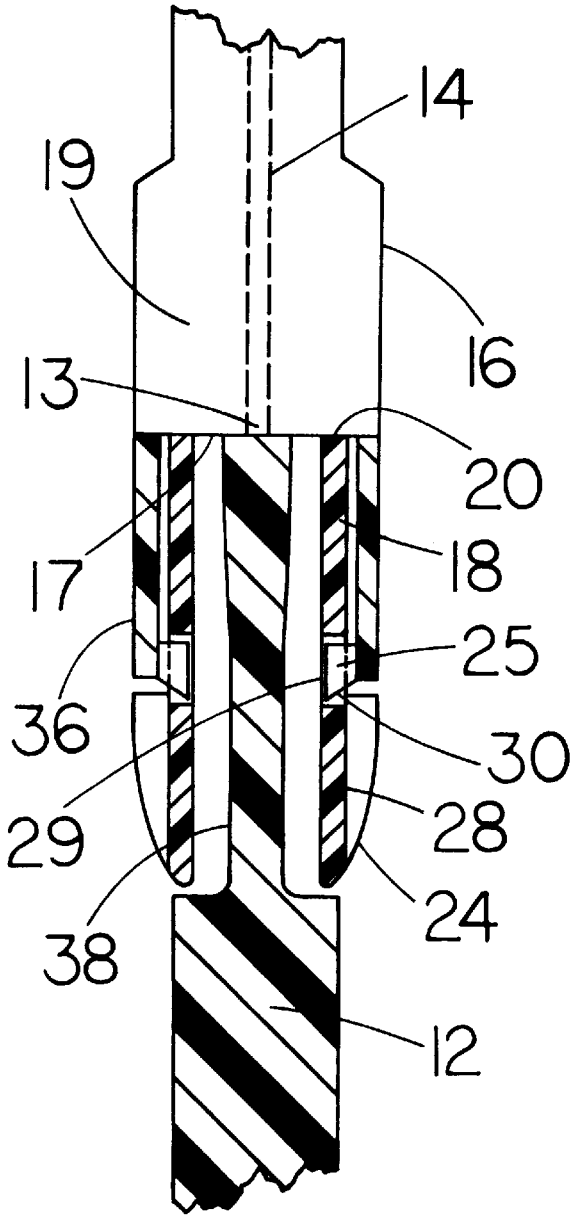
FIG. 6 is an elevational view of an edge of the second embodiment in the locked position shown partially cut away to expose the locking mechanism.

FIGS. 2 and 4 show versions of the first embodiment and the second embodiment, respectively, incorporating finger guards 59 on the handle 12. If preferred by a user, just one finger guard 59 can be included. In both instances, however, the basic locking mechanism operates the same as it would if no finger guards 59 were used.

OPERATION OF THE INVENTION

(FIGS. 7 AND 8)

As the knife 10 is inserted into the open end 17 of the sheath 16, the handle 12 is moved to a position such that each tunnel 32 is substantially in alignment with a distal end 22 of a flexible arm 18. When the knife 10 is pushed further into the sheath 16, the distal end 22 of each flexible arm 18 will enter the tunnel 32 that is aligned with that particular flexible arm 18. Continuing, each distal end 22 and groove 28 will then contact a tooth 25 and the flexible arms 18 will be flexed toward the tunnel floors 38. Further insertion provides for the groove 28 to ride along the tooth 25 of the respective tunnel 32 until the locking surface 30 of the tooth 25 reaches the notch 29. At that point, each flexible arm 18 snaps outward with respect to its tunnel floor 38 and the tooth 25 sits inside the notch 29.

In this position, the locking surface 30 of the tooth 25 will abut the shoulder defined by the notch 29 to secure the knife 10 within the sheath 16. Additionally, the rounded protrusions 24 extend outward through the rear openings 39.

When the knife 10 is fully inserted into the sheath 16, the open end 17 of the sheath 16 will be substantially flush against that portion of the handle 12 adjacent to the base 13 of the blade 14.

Figure 7:
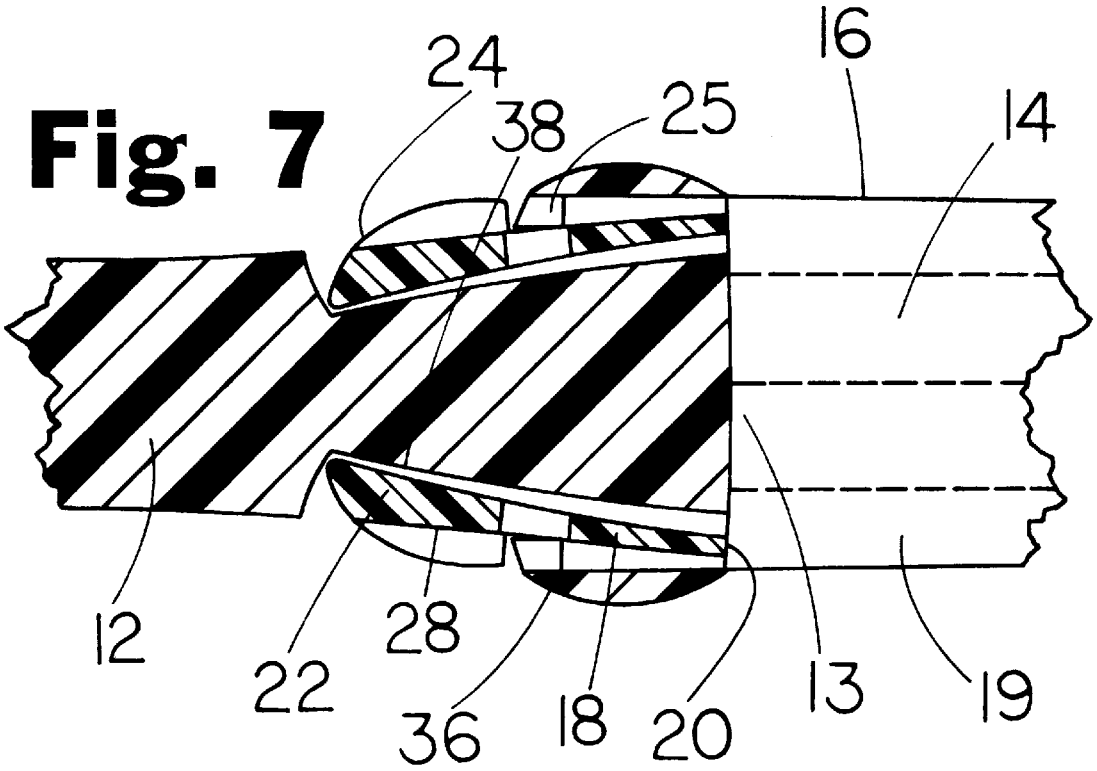
FIG. 7 is a side elevational view of the first embodiment illustrating the release of the knife from the sheath.
Figure 8:
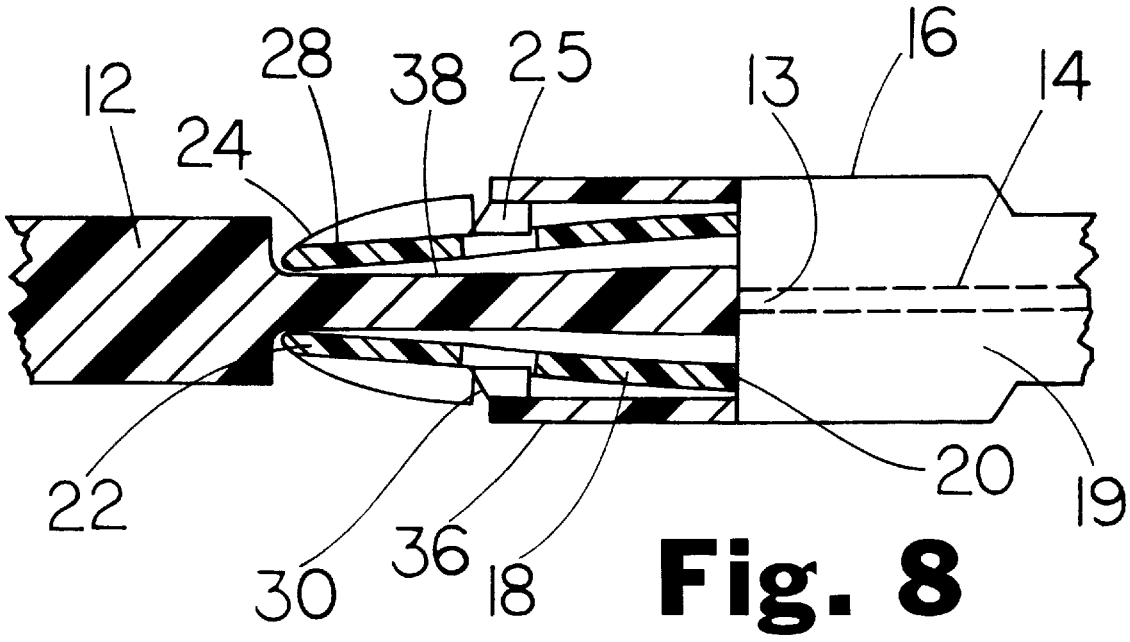
FIG. 8 is an elevational view of an edge of the second embodiment illustrating the release of the knife from the sheath.
Figure 9:
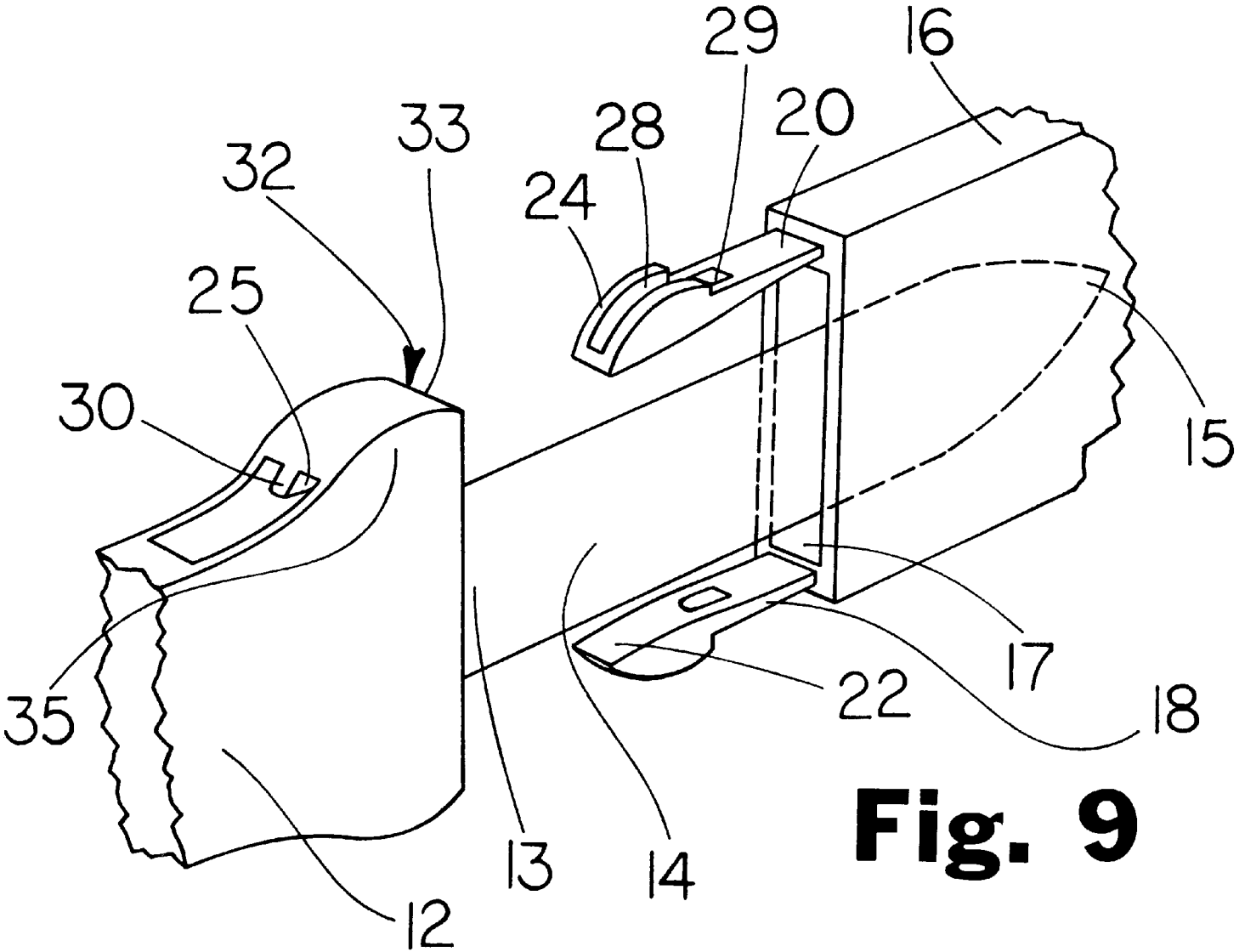
FIG. 9 is a perspective view of the first embodiment showing the locking mechanism uncoupled and the knife partially withdrawn from the sheath.
Figure 10:
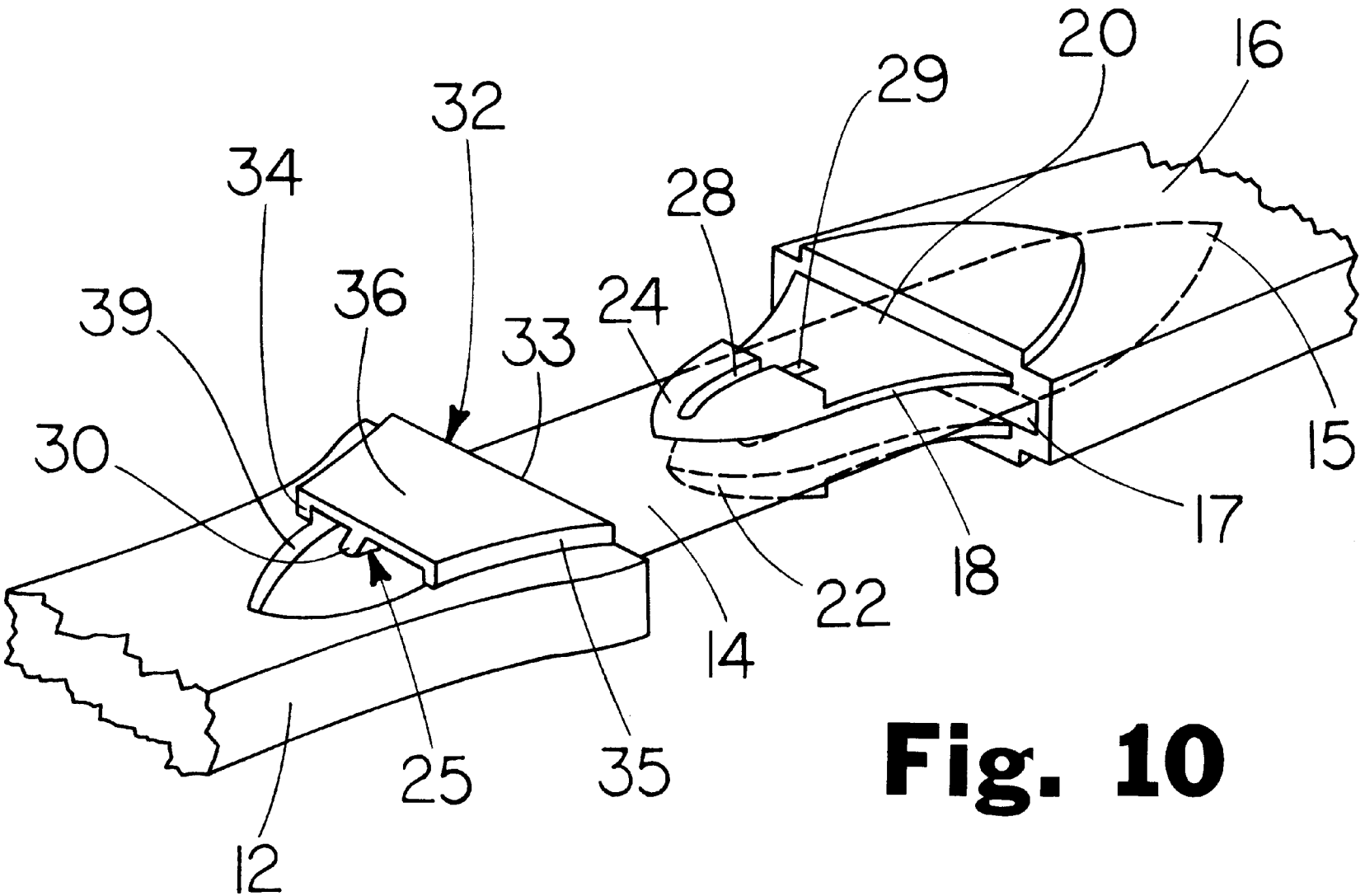
FIG. 10 is a perspective view of the second embodiment showing the locking mechanism uncoupled and the knife partially withdrawn from the sheath.

As FIGS. 7 and 8 both illustrate, to release the knife 10 from the sheath 16, a user engages the rounded protrusions 24 and exerts an inward pressure thereon to bend the flexible arms 18 toward the tunnel floors 38. Once the shoulders defined by the notches 29 clear the locking surfaces 30 of the teeth 25, the knife 10 can be withdrawn from the sheath 16.

SUMMARY, RAMIFICATIONS, AND SCOPE

Accordingly, the present invention provides a knife/sheath locking device that is particularly well-suited for use while in water or underwater. Because it is intended to be manufactured by injection-molding production techniques, both the handle and the sheath of the design can be economically made from a durable, corrosive-resistant material. Furthermore, this design provides a secure, accessible latch mechanism that can be easily operated by users wearing gloves, such as the gloves worn by underwater divers.

The locking mechanism provided by the present invention also has other advantages in that:

it can be used with knives having a variety of blade designs;

it provides a secure locking mechanism suitable for use with knife/sheath combinations of all sizes;

it does not require the manufacture and assembly of a number of component parts.

While the above description contains many specificities, these should not be construed as limiting the scope of the invention, but rather as an exemplification of the preferred embodiments. It will, however, be evident that various modifications and changes may be made without departing from the broader spirit and scope of the invention as set forth in the claims below.

I claim:

1. A knife/sheath combination, comprising:

a sheath, said sheath having a knife encasing portion and an open end;

a knife to be inserted into said sheath, said knife having a blade and a handle;

said handle having at least one tunnel structure located proximal to said blade of said knife, said tunnel structure being defined by a top wall, a bottom wall, and an outer wall, said tunnel structure having a front opening and a rear opening, and said tunnel structure incorporating latch-retaining means;

said sheath including at least one flexible arm extending outward from said open end in a direction toward said handle of said knife when said blade is enclosed within said sheath, said flexible arm positioned to be cooperatively accepted by said tunnel structure on said handle, and latch means disposed on said flexible arm for releasable locking engagement with said latch-retaining means of said tunnel structure upon insertion of said flexible arm within said tunnel structure;

said flexible arm and said tunnel structure shaped to provide an inward deflection of said flexible arm with respect to said knife handle upon insertion of said flexible arm within said tunnel structure until the point at which said latch means of said flexible arm engages said latch-retaining means of said tunnel structure, whereupon said flexible arm will flex in a direction outward with respect to said handle to obtain a locked position by the interaction of said latch means with said latch-retaining means;

said latch-retaining means in said tunnel structure comprising a tooth projecting from the inner surface of said outer wall of said tunnel structure, said tooth being substantially disposed on a midway line between said top wall and said bottom wall;

said latch means of said flexible arm comprising a notch defining a locking shoulder, said notch on said flexible arm being adapted to mate with said tooth in said tunnel structure when said knife is inserted into said sheath.

2. A knife/sheath combination as set forth in claim 1, wherein:

said sheath includes a second said flexible arm located on the opposite side of said sheath as the first said flexible arm, and said handle includes a second said tunnel structure located on the opposite side of said handle as the first said tunnel structure;

said flexible arms and said tunnel structures positioned such that each said flexible arm will be cooperatively accepted within a said tunnel structure as said knife is inserted into said sheath.

3. A knife/sheath combination as set forth in claim 1, wherein:

a distal end of said flexible arm includes a rounded protrusion and a groove, said groove and said rounded protrusion shaped to assist with the inward deflection of said flexible arm as said distal end enters said tunnel structure when said knife is inserted into said sheath;

said groove being adapted and positioned to receive and guide said tooth in said tunnel structure such that said tooth will slide along said groove when said knife is inserted further into said sheath until the point at which said tooth reaches said notch, whereupon said flexible arm will flex outward to reach the locked position.

4. A knife/sheath combination as set forth in claim 3, wherein:

said tooth in said tunnel structure and said notch on said flexible arm are positioned such that said rounded protrusion on said distal end of said flexible arm will protrude from said rear opening of said tunnel structure when said knife is in the locked position within said sheath.

* * * * *